US005155929A

United States Patent [19]

Vachon

[11] Patent Number: 5,155,929

[45] Date of Patent: Oct. 20, 1992

[54] VEHICLE SNOWPLOW ATTACHMENT

[76] Inventor: Gaston Vachon, Box 1, Field, Ontario, Canada, P0H 1M0

[21] Appl. No.: 878,528

[22] Filed: May 5, 1992

[51] Int. Cl.[5] ..... E01H 5/06

[52] U.S. Cl. ..... 37/266; 37/231; 37/232; 37/275

[58] Field of Search ..... 37/231, 232, 236, 266, 37/274, 275

[56] References Cited

U.S. PATENT DOCUMENTS

| | | | |
|---|---|---|---|
| 2,085,996 | 7/1937 | Phillips | 37/275 X |
| 3,432,947 | 3/1969 | Peitl | 37/275 X |
| 4,587,750 | 5/1986 | Larson | 37/266 X |

FOREIGN PATENT DOCUMENTS

| | | | |
|---|---|---|---|
| 194427 | 1/1958 | Austria | 37/232 |
| 3316699 | 3/1984 | Fed. Rep. of Germany | 37/232 |
| 34289 | 3/1965 | Finland | 37/266 |

*Primary Examiner*—Randolph A. Reese
*Assistant Examiner*—Arlen L. Olsen
*Attorney, Agent, or Firm*—Philip W. Jones

[57] ABSTRACT

A snowplow deflector assembly is attachable to that type of snowplow which is mounted on the front end of a vehicle. The deflector assembly comprises a deflector member which is supported to extend over the top of the blade of the snowplow to deflect snow moving off the top of the blade, that snow being thereby substantially prevented from being thrown against the windshield of the vehicle and obstructing the view of a driver. Two embodiments of the invention are described.

11 Claims, 6 Drawing Sheets

VEHICLE SNOWPLOW ATTACHMENT

BACKGROUND OF THE INVENTION

The invention relates to a snowplow deflector assembly for a vehicle, and more particularly, to a deflector assembly that may be utilized with an existing vehicle snowplow apparatus to reduce the quantity of snow that otherwise moves off the top of the snowplow apparatus to obstruct the view of a driver of the vehicle.

In northern climates removal of snow from roads, driveways, parking lots and other open areas can be a major undertaking. One common type of snow removal apparatus which can be fitted to the front of a light truck such as a pickup truck has a frame and a blade pivotally connected through an elevating mechanism to the frame. Actuation of the elevating mechanism is usually accomplished by means of a hydraulic piston. One problem that has been encountered with use of such snow removal apparatus on a vehicle is obstruction of the driver's view by snow moving off the top of the blade and blowing against the vehicle windshield. The faster the vehicle is driven, the worse this problem becomes.

It has been found that if a deflector member is placed over the top of the blade such that a gap is created between the deflector member and the top of the blade, a substantial portion of any snow moving off of the top of the blade when the vehicle is in motion is drawn into the gap and then downwardly along the back surface of the blade. It is believed that this effect may be due to air flow into the gap, resulting from pressure differentials that are created around the vehicle by its motion.

The invention in one form is a snowplow deflector assembly adapted to be fitted to the type of snowplow apparatus which is connectable to the front of a vehicle and which has a blade and a blade elevating means for elevating the blade from a lowered active position to a raised passive position. The deflector assembly comprises a deflector member extending in spaced relation over the blade in the active position. The deflector member is oriented relative to the blade such that when the blade is in the active position a forward end of the deflector member extends forward of the top of the blade and a gap exists between the top of the blade and that part of the deflector member that crosses above the top of the blade. The size of the gap and the relative orientation between the deflector member and the blade in the active position is such that, when the vehicle is driven across a snow-covered surface with the snowplow apparatus connected and the deflector assembly fitted, a substantial portion of any snow leaving the top of the blade is drawn into the gap between the blade and the deflector member.

The blade elevating means may be of the type having a frame member fitted to the front of the vehicle, a hoist assembly connected to the blade and pivotally connected to the frame member, and an actuator means for causing the hoist assembly to move relative to the frame member. With this arrangement, the deflector assembly may be connected to a first portion of the hoist assembly and rotate with that first portion during actuation of the actuator means. Alternatively, with this arrangement, the deflector assembly may be suspended from a first portion of the hoist assembly and be pivotally connected to a second portion of the hoist assembly for rotation during actuation of the actuator means. The deflector member in either arrangement may be connected to the rest of the deflector assembly such that the forward end of the deflector member is adjustably positionable relative to the top of the blade.

The invention in another form is a snowplow attachment connectable to the front of a vehicle, the attachment comprising a blade, a blade elevating means and a deflector assembly. The blade elevating means is connected to the blade and connectable to the vehicle for raising the blade from a lowered active position to a raised passive position. The deflector assembly comprises a deflector member extending in spaced relation above the blade in the active position. The deflector member is oriented relative to the blade such that when the blade is in the active position a forward end of the deflector member extends forward of the top of the blade and a gap exists between the top of the blade and that part of the deflector member that crosses above the top of the blade. The size of the gap and the relative orientation between the deflector member and blade in the active position is such that, when the vehicle is driven across a snow-covered surface with the snowplow attachment connected, a substantial portion of any snow leaving the top of the blade is drawn into the gap between the blade and the deflector member.

BRIEF DESCRIPTION OF THE DRAWINGS

The invention will next be more fully described by means of two preferred embodiments, utilizing the accompanying drawings, in which.

DESCRIPTION OF THE PREFERRED EMBODIMENTS

Figure 1:
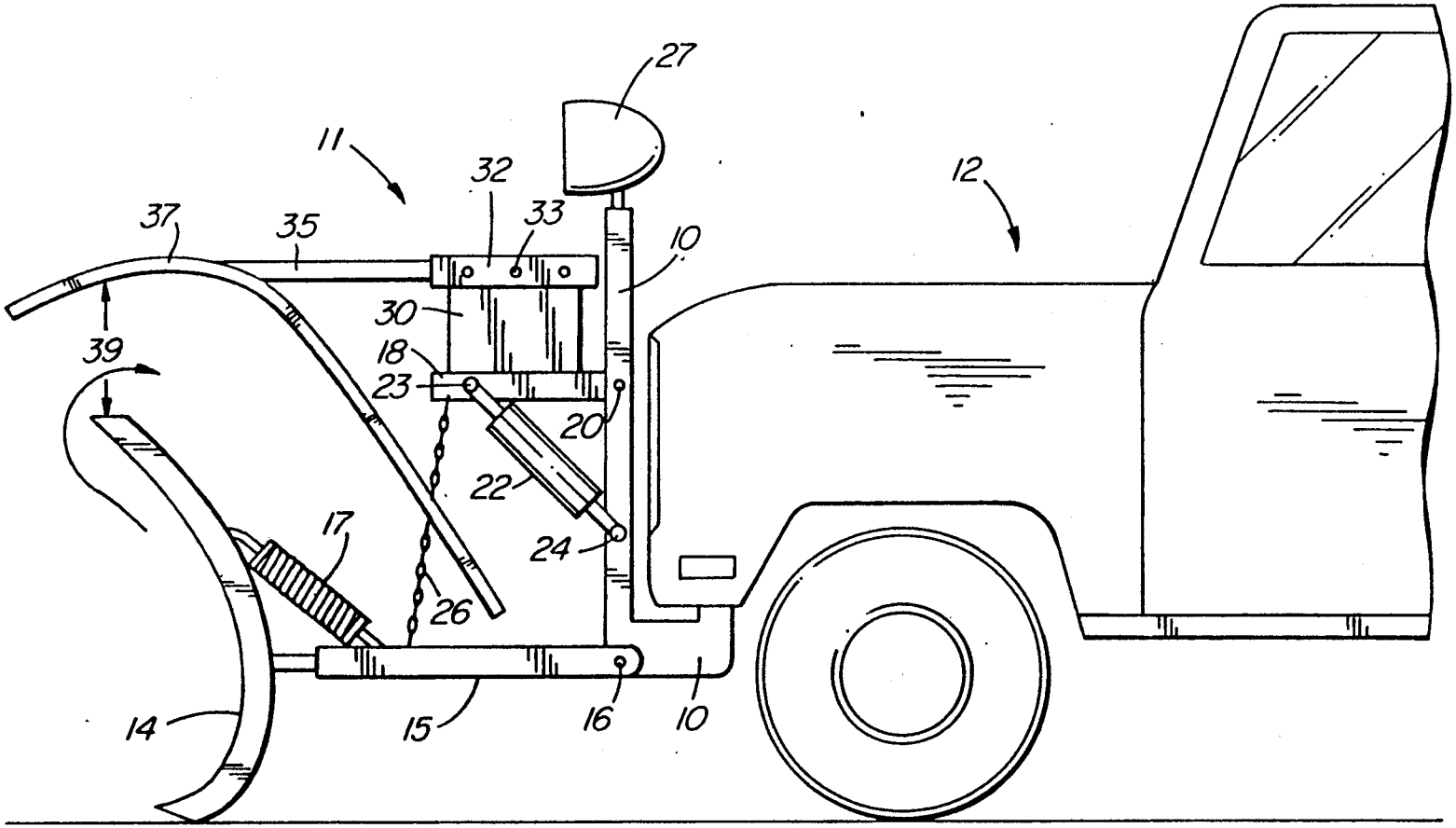
FIG. 1 illustrates a side view of the front end of a vehicle and a connected first embodiment of the snowplow deflector attachment of the invention, the blade of the attachment being in the lowered position.

With respect to FIG. 1, a frame member 10 of a snowplow deflector attachment generally designated as 11 is mounted to the front end of a vehicle generally designated as 12. A blade member 14 is connected to a support bar 15, which in turn is pivotally connected to frame member 10 at a pivot point 16. A spring means 17 is connected between blade member 14 and support bar 15 to provide a limited amount of flexion between the two. An arm 18 is pivotally connected to frame member 10 at a pivot point 20. A hydraulic piston mechanism 22 is pivotally connected to arm 18 and frame member 10 at pivot points 23 and 24, respectively, for rotating arm 18 relative to frame member 10. Actuation of hydraulic piston mechanism 22 is by means of a hydraulic pump (not shown) which is powered by vehicle 12 and connected to mechanism 22 through hydraulic lines (not shown). A chain 26 extends between an outer end of arm 18 and an outer position on support bar 15. A pair of headlamps 27 are each mounted on an opposite end of the top of frame member 10 to provide light for night driving and plowing by vehicle 12. With this arrangement, actuation of piston mechanism 22 raises blade member 14 from a lowered position where it is proximate the ground to the raised position illustrated in FIG. 2.

The elements of the snowplow attachment described in the preceding paragraph have been known for some time.

Figure 2:
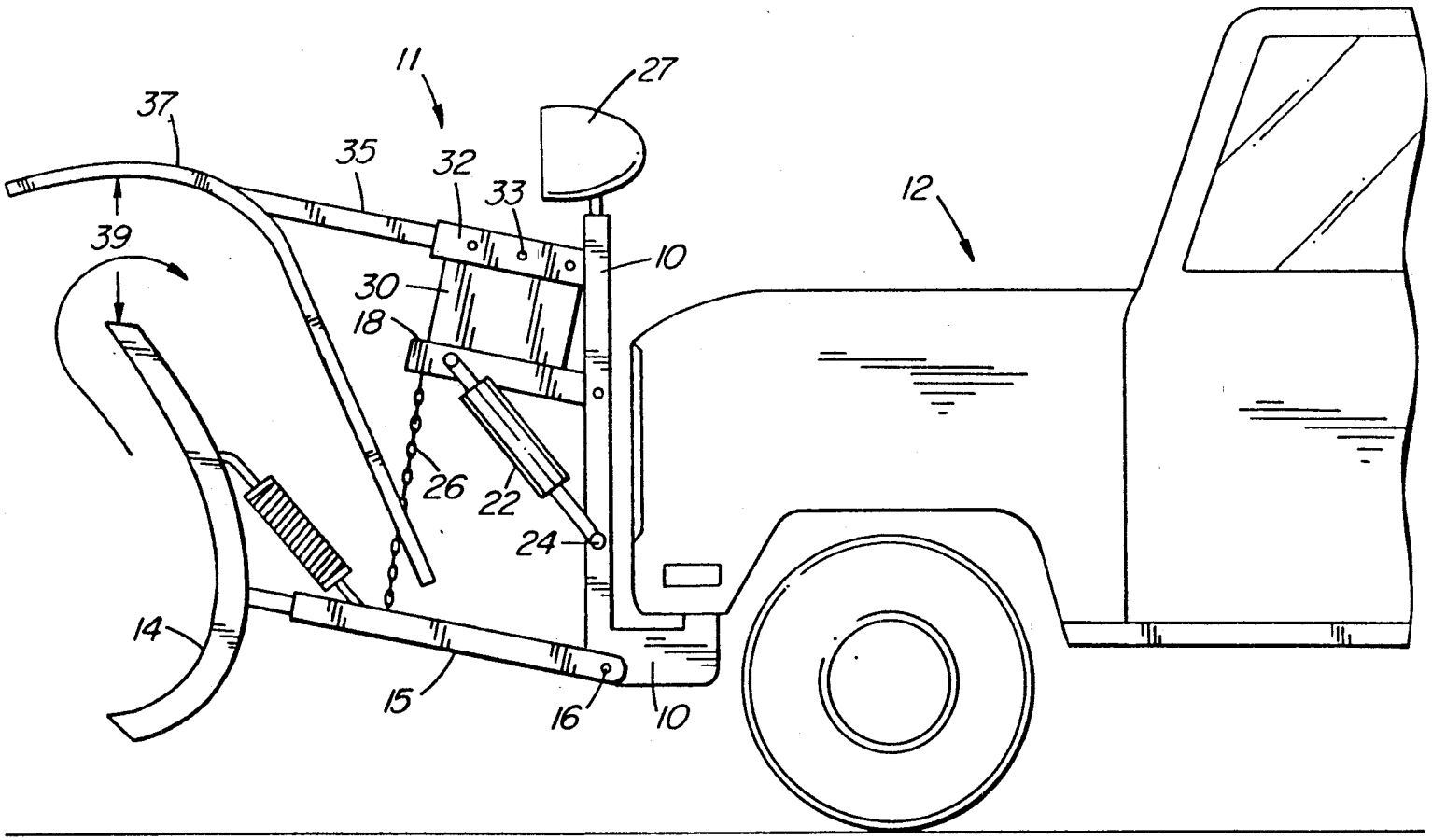
FIG. 2 is a side view similar to FIG. 1, but showing the blade of the attachment in the raised position.
Figure 3:
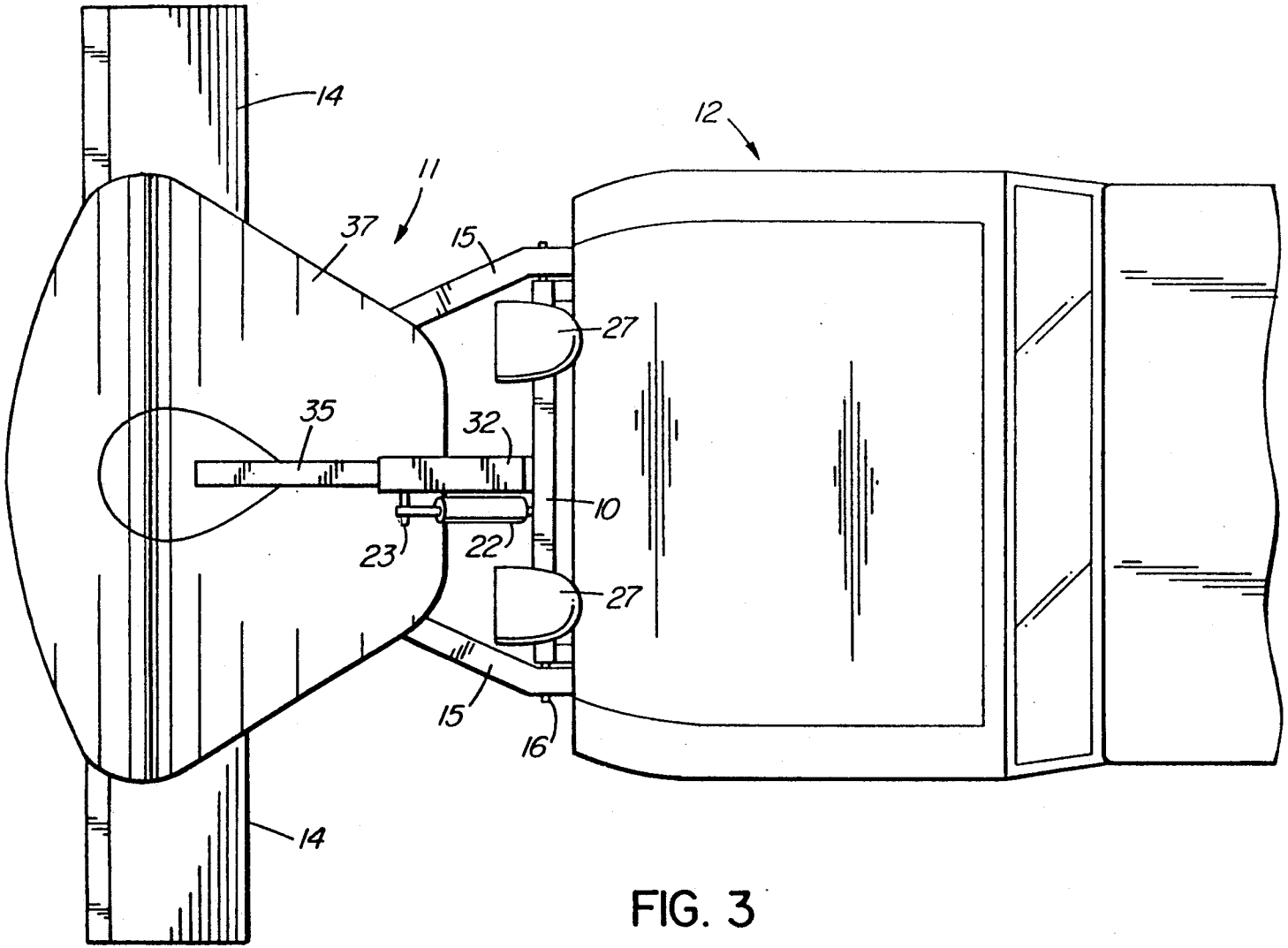
FIG. 3 is a top view of the front end of a vehicle and the connected first embodiment of the snowplow deflector attachment of the invention.

A steel plate 30 is welded to the top of arm 18 to extend vertically, as shown in FIG. 1, and a piece of steel square tubing 32 is welded symmetrically to the top of plate 30. In this embodiment, tubing 32 has three pairs of spaced holes 33 in its sides; a larger number of holes might be used. One end of a steel square rod 35 is fitted within tubing 32, the other end of rod 35 being rigidly connected to a deflector member 37 shown in profile in FIG. 1 and in plan view in FIG. 3. Rod 35 has a hole bored in its one end to allow rod 35 to be adjustably positioned relative to tubing 32. The hole in rod 35 is aligned with one of the pair of holes 33 in tubing 32, and a pin or bolt (not shown) is extended through the three aligned holes to fix the relative position of the two members. A gap 39 exists between the top of blade member 14 and the underside of deflector member 37. The height of the gap 39 remains approximately constant during actuation of piston mechanism 22, as illustrated in FIGS. 1 and 2. The height of gap 39 can, however, be varied by adjusting the relative position of rod 35 relative to tubing 32; gap 39 is typically about six inches.

The pair of holes 33 with which the hole in rod 35 is matched depends on several factors, and is a matter of the particular vehicle operator becoming comfortable with the operation of the snowplow deflector attachment of the invention. For instance, if the vehicle is to be used for plowing at increased speed the vehicle operator shifts rod 35 relative to tubing 32 such that gap 39 is increased. With increased speed a greater gap 39 is required to divert the same proportion of snow moving off the top of blade 14.

Deflector member 37 is made of plastic or light metal so as not to unduly strain the hydraulic motor connected to piston mechanism 22, that motor being originally sized for lifting only blade 14 and support bar 15. For high-speed highway movement of the vehicle between plowing locations, rod 35 is pulled out of tubing 32 and the deflector member 37 placed onto the back of the vehicle.

Figure 4:
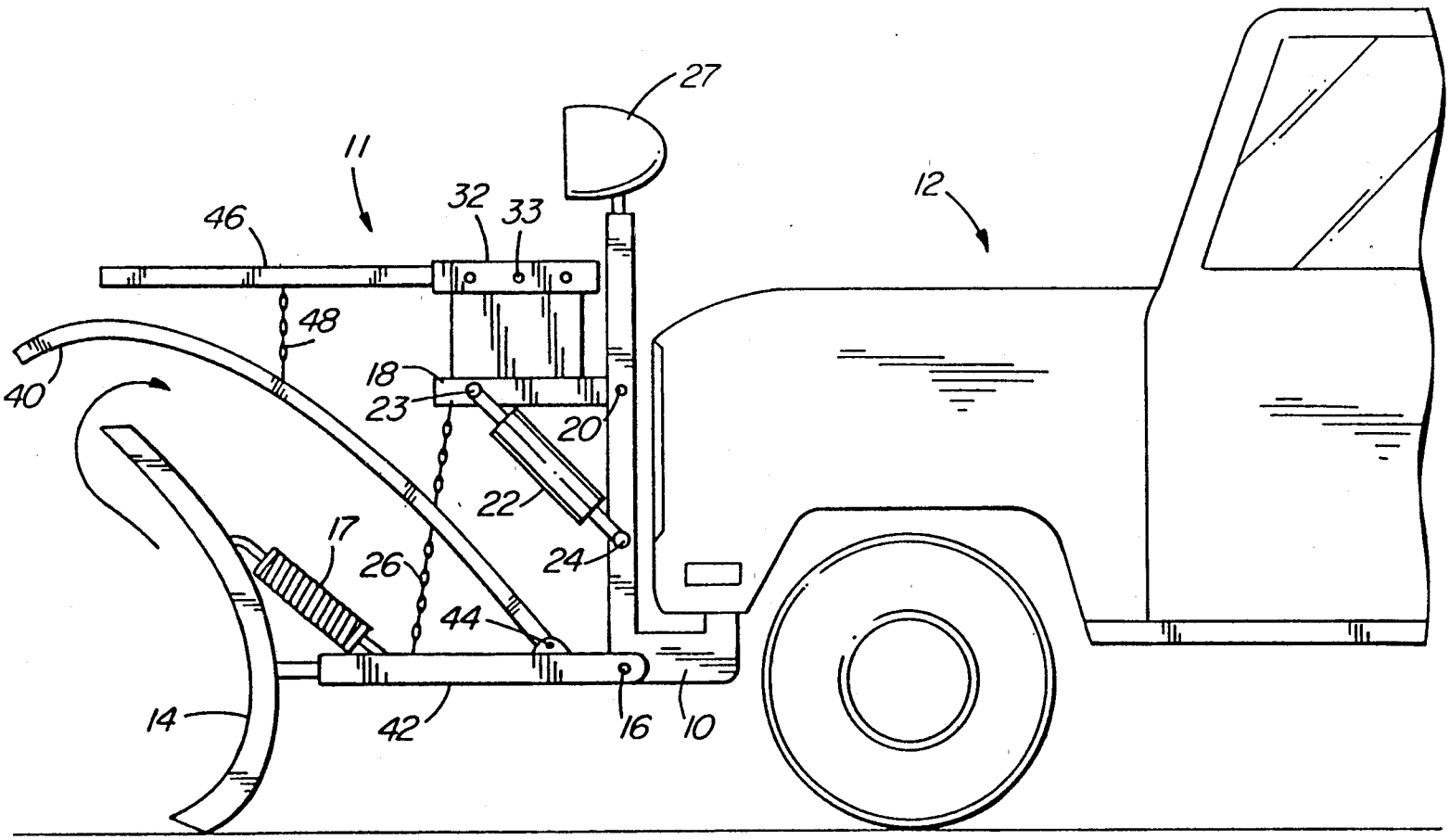
FIG. 4 illustrates a side view of the front end of a vehicle and a connected second embodiment of the snowplow deflector attachment of the invention, the blade of the attachment being in the lowered position.
Figure 5:
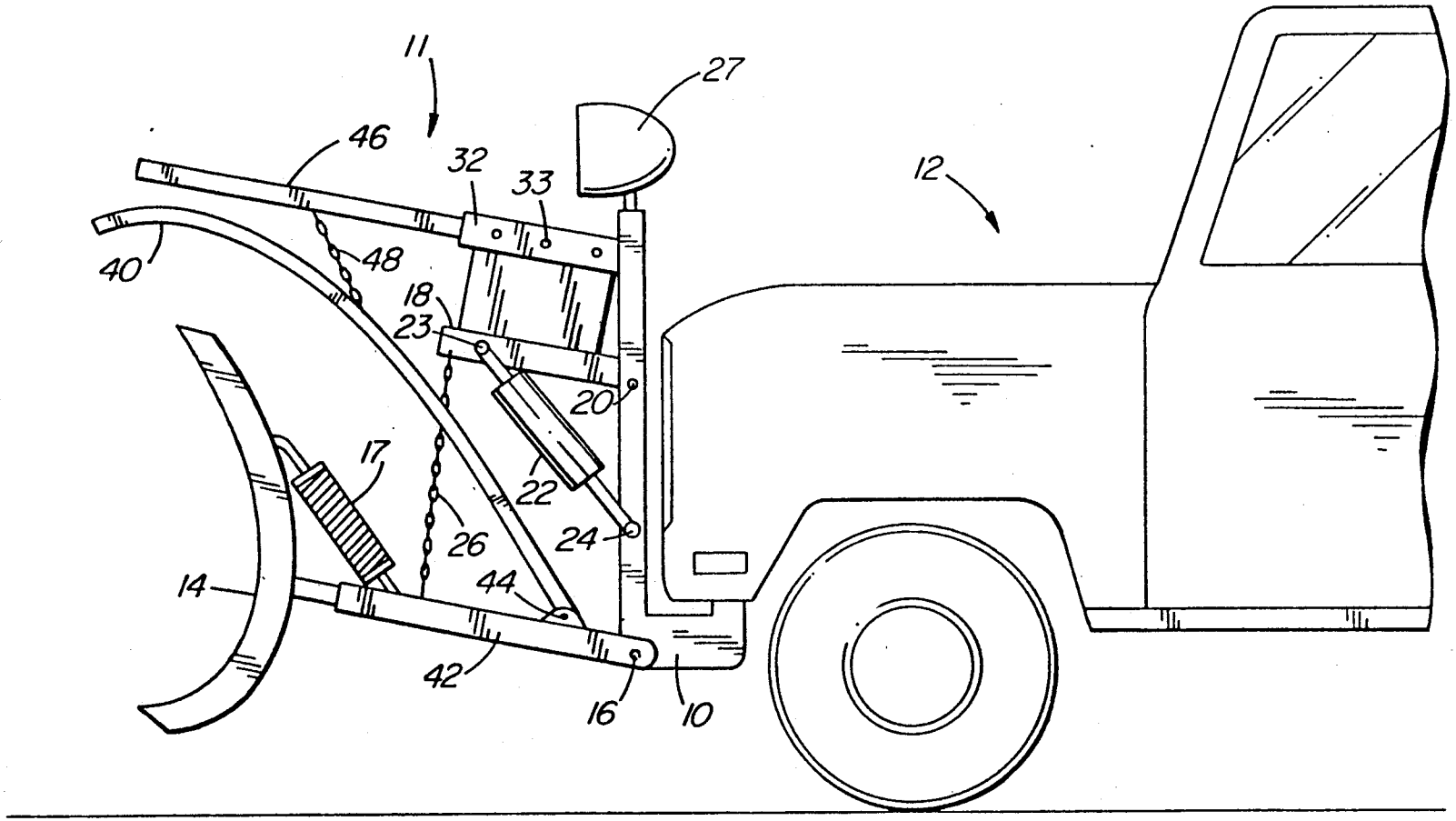
FIG. 5 is a side view similar to FIG. 4, but showing the blade of the attachment in the raised position.
Figure 6:
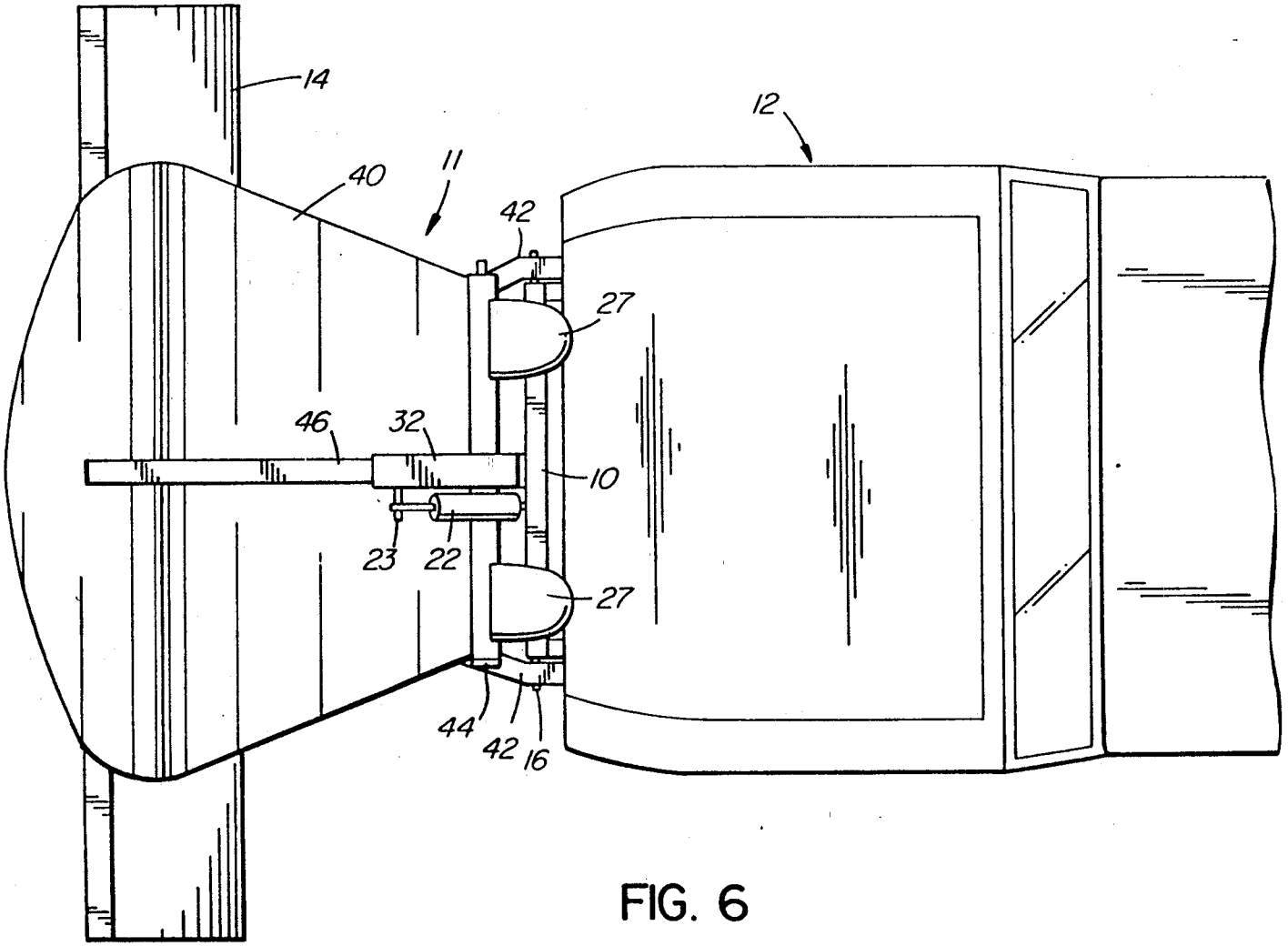
FIG. 6 is a top view of the front end of a vehicle and the connected second embodiment of the snowplow deflector attachment of the invention.

FIGS. 4, 5 and 6 illustrate a second embodiment of the snowplow attachment. The second embodiment differs from the first in that deflector member 40 has one end pivotally connected to support bar 42 at a pivot point 44, and in that deflector member 40 is suspended from rod 46 by a chain 48. For highway travel, deflector member 40 can be disconnected from support bar 42 by removal of a pivot pin positioned at pivot point 44. As illustrated in FIGS. 4 and 5, the gap between the top of blade member 14 and the underside of deflector member 40 remains approximately constant during actuation of piston mechanism 22.

Although the invention may be sold as a deflector assembly to be added to an existing snowplow apparatus, the invention could also be incorporated into the design of new snowplow attachments for vehicles.

I claim:

1. A snowplow attachment comprising:

a frame adapted to be attached to the front of a vehicle;

a first support member pivotally connected to a lower portion of the frame and having a scraper blade attached thereon;

a second support member pivotally connected to an upper portion of the frame;

actuator means for simultaneous manipulation of said first and second support members; and, a deflector assembly fixed to said second support member and including a deflector member extending forwardly of the second support member over the top of said blade to thereby form a gap between the deflector member and the scraper blade, whereby when the vehicle is driven across a snow-covered surface, a substantial portions of any snow leaving the top of the blade is drawn into the gap between the blade and the deflector member.

2. The snowplow attachment of claim 1 wherein the deflector member is horizontally adjustable relative to the top of the scraper blade.

3. The snowplow attachment of claim 1, wherein the deflector assembly is welded to the second support member.

4. A snowplow attachment comprising:

a frame adapted to be attached to the front of a vehicle;

a first support member pivotally connected to a lower portion of the frame and having a scraper blade attached thereon;

a second support member pivotally connected to an upper portion of the frame;

actuator means for simultaneous manipulation of said first and second support members; and, a deflector assembly connected to said first and second support members and including a deflector member extending forwardly of the support members over the top of said blade to thereby form a gap between the deflector member and the scraper blade, whereby when the vehicle is driven across a snow-covered surface, a substantial portion of any snow leaving the top of the blade is drawn into the gap between the blade and the deflector member.

5. The snowplow attachment of claim 4, wherein the deflector member is horizontally adjustable relative to the top of the scraper blade.

6. The snowplow attachment of claim 4, wherein the deflector member is pivotally connected to the first support member and suspended by suspension means from a bar extending from the second support member.

7. A snowplow deflector assembly connectable to a snowplow apparatus of the type that comprises a frame adapted to be attached to the front of a vehicle, a first support member pivotally connected to a lower portion of the frame and having a scraper blade attached thereon, a second support member pivotally connected to an upper portion of the frame and actuator means for simultaneous manipulation of said first and second support members, said snowplow deflector assembly comprising:

a deflector member fixed to said second support member at a location to the rear of said scraper blade, the deflector member extending forwardly of the second support member over the top of said blade to thereby form a gap between the deflector member and the scraper blade whereby when the vehicle is driven across a snow-covered surface, a substantial portion of any snow leaving the top of the blade is drawn into the gap between the blade and the deflector member.

8. The snowplow deflector assembly of claim 7, wherein the deflector member is horizontally adjustable relative to the top of the scraper blade.

9. The snowplow deflector assembly of claim 7, wherein the deflector assembly is welded to the second support member.

10. A snowplow deflector assembly connectable to a snowplow apparatus of the type that includes a frame adapted to be attached to the front of a vehicle, a first support member pivotally connected to a lower portion of the frame and having a scraper blade attached thereon, a second support member pivotally connected to an upper portion of the frame, and actuator means for simultaneous manipulation of said first and second support members, said snowplow deflector assembly comprising:

a deflector member suspended by suspension means from a bar extending from the second support member and pivotally connected to said first support member at a location to the rear of said scraper blade, the deflector member extending forwardly of the support members over the top of said blade to thereby form a gap between the deflector member and the scraper blade whereby when the vehicle is driven across a snow-covered surface, a substantial portion of any snow leaving the top of the blade is drawn into the gap between the blade and the deflector means.

11. The snowplow deflector assembly of claim 10, wherein the deflector member is horizontally adjustable relative to the top of the scraper blade.

* * * * *